US010493312B2

(12) United States Patent
Breland et al.

(10) Patent No.: US 10,493,312 B2
(45) Date of Patent: Dec. 3, 2019

(54) LADDER WITH DETACHABLE ELASTIC BANDS OR SPRINGS FOR PERFORMING RESISTANCE EXERCISES INCORPORATING THE LADDER RUNGS AND/OR A DETACHABLE BACKBOARD

(71) Applicant: Fuse 360 LLC, Washington, DC (US)

(72) Inventors: Mariska Breland, Washington, DC (US); Roxanna Hakimi, Washington, DC (US)

(73) Assignee: Fuse360 LLC, Washington, DC (US)

( * ) Notice: Subject to any disclaimer, the term of this patent is extended or adjusted under 35 U.S.C. 154(b) by 100 days.

(21) Appl. No.: 15/841,048

(22) Filed: Dec. 13, 2017

(65) Prior Publication Data

US 2019/0175976 A1 Jun. 13, 2019

(51) Int. Cl.
*A63B 21/055* (2006.01)
*A63B 21/04* (2006.01)
(Continued)

(52) U.S. Cl.
CPC .... *A63B 21/0557* (2013.01); *A63B 21/00061* (2013.01); *A63B 21/0442* (2013.01); *A63B 21/169* (2015.10); *A63B 21/4034* (2015.10); *A63B 23/0355* (2013.01); *A63B 2208/0204* (2013.01); *A63B 2208/0233* (2013.01); *A63B 2208/0238* (2013.01);
(Continued)

(58) Field of Classification Search
CPC ..... A63B 21/00061; A63B 21/0557; A63B 21/0442; A63B 21/169; A63B 21/4034; A63B 21/4043; A63B 21/4035; A63B 23/0355; A63B 2208/0252; A63B 2208/0238; A63B 2208/0233; A63B 2208/0204; A63B 2208/0257; A63B 2225/093
See application file for complete search history.

(56) References Cited

U.S. PATENT DOCUMENTS 1,822,786 A * 9/1931 Raffo ..... A63B 9/00 482/36
4,927,135 A * 5/1990 Nieppola ..... A63B 9/00 182/95
(Continued)

OTHER PUBLICATIONS

Holley Simmons et al., "Fuse Ladder introduces students to a new Pilates apparatus (and forgotten muscles)", The Washington Post Express, Nov. 4, 2014, published online at https://www.washingtonpost.com/express/wp/2014/11/04/fuse-ladder-introduces-students-to-a-new-pilates-apparatus-and-forgotten-muscles/?utm_term=.c3956ccb8b9c.

*Primary Examiner* — Megan Anderson
(74) *Attorney, Agent, or Firm* — Vector IP Law Group LLC; Robert S. Babayi

(57) ABSTRACT

An exercise ladder has a vertical ladder frame that includes one or more wall support blocks configured to fix the vertical ladder frame against a wall that is perpendicular to a floor. The ladder frame has vertical rails on each side. Each vertical rail has a track that allows a carrier of hook and a lock to slide up on down the length of the ladder frame. An exerciser can easily change the height of the hook with a slide action that changes the height of the carrier and a locking action that locks the carrier at an adjustable height. In this way, a exerciser can perform resistance exercises with an elastic band that attach at different heights without having to disengage the elastic band from the hook.

6 Claims, 17 Drawing Sheets

(51) Int. Cl.
*A63B 21/00* (2006.01)
*A63B 23/035* (2006.01)
*A63B 21/16* (2006.01)

(52) U.S. Cl.
CPC ..... *A63B 2208/0252* (2013.01); *A63B 2208/0257* (2013.01); *A63B 2225/093* (2013.01)

(56) References Cited

U.S. PATENT DOCUMENTS

| | | | | | |
|---|---|---|---|---|---|
| 5,080,352 | A * | 1/1992 | Freed | A63B 21/00047 | 482/140 |
| 6,626,801 | B2 * | 9/2003 | Marques | A63B 17/00 | 482/23 |
| 8,057,370 | B2 * | 11/2011 | Dunn | A63B 21/0552 | 482/121 |
| 8,317,661 | B2 * | 11/2012 | Wight | A63B 23/0464 | 482/37 |
| 9,421,411 | B2 * | 8/2016 | Stallman | A63B 21/00047 | |
| 9,802,075 | B2 * | 10/2017 | Gvoich | A63B 21/4035 | |
| 2015/0238799 | A1 * | 8/2015 | Arline | A63B 21/0442 | 482/129 |

* cited by examiner

Prior Art

LADDER WITH DETACHABLE ELASTIC BANDS OR SPRINGS FOR PERFORMING RESISTANCE EXERCISES INCORPORATING THE LADDER RUNGS AND/OR A DETACHABLE BACKBOARD

FIELD OF THE INVENTION

The present invention generally relates to ladders and more specifically to a ladder used for performing resistance exercises in multiple positions, including standing, seated, supine, and prone, and combining the use of variable height elastic bands or springs, in addition to the varied height ladder rungs and a detachable and movable backboard.

BACKGROUND

Various Pilates exercise apparatuses are known. One common example is the first Pilates machine created by Joseph Pilates in the last century. Ever since, various types of Pilates machines have been devised. One Pilates machine is known as reformer tower (shown in FIG. 1), which allows exercisers to perform Pilates exercises at different heights where springs attach. Another Pilates-inspired machine is known as the Fuse Ladder® (shown in FIG. 2), which allows exercisers to perform exercises at the height of any of the rungs offering more height options, as well as perform numerous Pilates and non-Pilates exercises unique to the design of the equipment, including using the rungs themselves within an exercise, with or without the springs, and using a backboard, which can be hung or leaned upon any of the rungs, for exercises also with or without using the springs.

FIG. 1 shows a known tower reformer that has a wheeled carriage, which travels within a range along a pair of parallel rails or tracks. This reformer tower has a rectangular frame placed parallel to the floor that supports the pair of parallel rails or tracks along which the wheeled carriage can travel. In this way, the carriage moves parallel to the floor upon which the reformer tower rests. The movement is facilitated by a pulley system. Elastic bands or springs allow the carriage to move back and forth in a longitudinal direction along the frame tracks. The carriage has a pair of "shoulder rests" where an exerciser lays his or her head between them supported by the exerciser's shoulders and a "foot bar" where the exerciser places his or her feet while laying down with back of the body facing the floor and front of the body facing the ceiling. The exerciser can sit or lie on the carriage and push against the foot bar to move the carriage away from the foot bar.

As shown in FIG. 1, a perpendicular frame to the floor is attached to one end of the parallel frame, which has opposing vertical rails at each side that are parallel to each other. The vertical rails each have a track in the form of groves that engage with a slide-able hook and lock carrier. Different springs having grips at one end can be attached to the slide-able hook attachments allowing the exerciser to perform resistance exercises lying down or in seated positions, or standing behind the tower. Each spring is attached to handles or loops at one end and to a hook at the other end. The hook can be slide-ably locked to a vertical rail. The spring and the grip can be removed from the hook to allow the exerciser to vary the amount of force needed for seated, standing, or lay-down (supine) exercises. For times when the slide-able carrier of the hook is locked to the perpendicular rails, the elastic bands or springs allow the exerciser to either sit or lie down on the carriage to perform resistance exercises. An exerciser can also stand off the back of the reformer tower to perform standing exercises.

FIG. 2 shows a ladder attached to a wall (or floor) that allows the exerciser to perform stand-up exercises in extended ranges. This ladder was created by a co-inventor of the present invention, Ms. Mariska Breland, and marketed as Fuse Ladder®. The Fuse ladder of FIG. 2 has a main body that comprises a vertical ladder frame that is perpendicular to the floor with rungs providing steps for various exercises. Support blocks secure the ladder to a fixed structure/wall during exercises. FIG. 3 shows a partial view of the prior art Fuse ladder of FIG. 2, which has a right side and a left side vertical rails with a plurality of rungs, where each rung is fixed at points along the width of the right and left side rails. FIG. 4 shows eyelets used in the ladder of FIG. 3 as hooks shaped like a ring that are fixedly, i.e., non-removably, attached to the rail. The eyelet hooks to different springs at a fixed point along the vertical rail. FIG. 5 shows the hooks being used for attaching springs. A backboard can be removable attached to the main body of the exercise apparatus by hanging from any one of the rungs of the ladder frame for numerous exercises using the prior art Fuse ladder.

Also known is a springboard fixed to a wall as shown in FIGS. 6-8. The spring board is a flat wooden board with attachments for springs for various exercise moves. FIG. 9 shows a spring having a clasp at one end and a grip or handle on the other end with the spring connecting the two ends. Exercises are performed by using the grips of elastic bands, which connect to the eyelets. One of the disadvantages that the Fuse ladder of the prior art is that an exerciser who wants to adjust the height of the fixing point of a spring to the rail must disconnect the elastic band from one eyelet at one height and reconnect it to an eyelet at a different height. This is because the eyelets are fixed to the rail by a screw.

Although various types of exercise apparatuses are known, there is a need to provide a ladder that allows for elastic resistance exercises with spring loads that can be easily adjusted to a desired height and which allows exercisers to quickly transition to perform a variety of exercise that cannot be performed by known exercise apparatuses.

SUMMARY

Briefly, according to the present invention, an exercise ladder has a vertical ladder frame that includes one or more wall support blocks configured to fix the vertical ladder frame against a wall that is perpendicular to a floor. The ladder frame has a first vertical rail and a second vertical rail that are separated from each other to form the width of the ladder frame. The first and second vertical rails extend in parallel along the length of the ladder frame substantially perpendicular to the floor. Each one of the first and second vertical rails includes a bottom side facing the floor and a top side opposite the bottom side. A back side of each vertical rail faces the wall. A front side opposite the back side includes a plurality of lock recesses disposed at corresponding recess heights along the length of the ladder frame. Each vertical rail further includes a right side and a left side disposed between the front side and the back side. A corresponding longitudinal track is formed on each one of the first and second vertical rails. A plurality of rungs extends along the width of the ladder frame such that each rung is fixed to the first and second of vertical rails at a corresponding rung height along the length of the ladder frame. One or more first slide-able carriers are attached to the first vertical rail and one or more second slide-able carriers are attached to the second vertical rail. Each one of the first and second slide-able carriers has a corresponding enclosure that carries a hook and a lock. The enclosure engages the longitudinal track formed on the right and left sides of each vertical rail. The lock carried by a slide-able carrier engages and disengages the plurality of lock recesses disposed on the front side of each vertical rail at different lock heights. One or more elastic bands having a corresponding grip are detachably connected to a corresponding hook carried by the one or more first and second slide-able carriers.

According to some of the more detailed features of the invention, a backboard can be attached to each rung at the corresponding rung height. The track can be formed by a first longitudinal groove disposed at the right side and a second longitudinal groove disposed at the left side of each vertical rail, where the first and second longitudinal grooves form the track that engages a carrier. The ladder frame further comprises overhang rungs at the top sides of the first and second vertical rail. The recess locks can comprise holes or indentations disposed on the front side of each vertical rail. The lock can comprise a spring-loaded pin that engages the holes or indentations.

DETAILED DESCRIPTION

Figure 1:
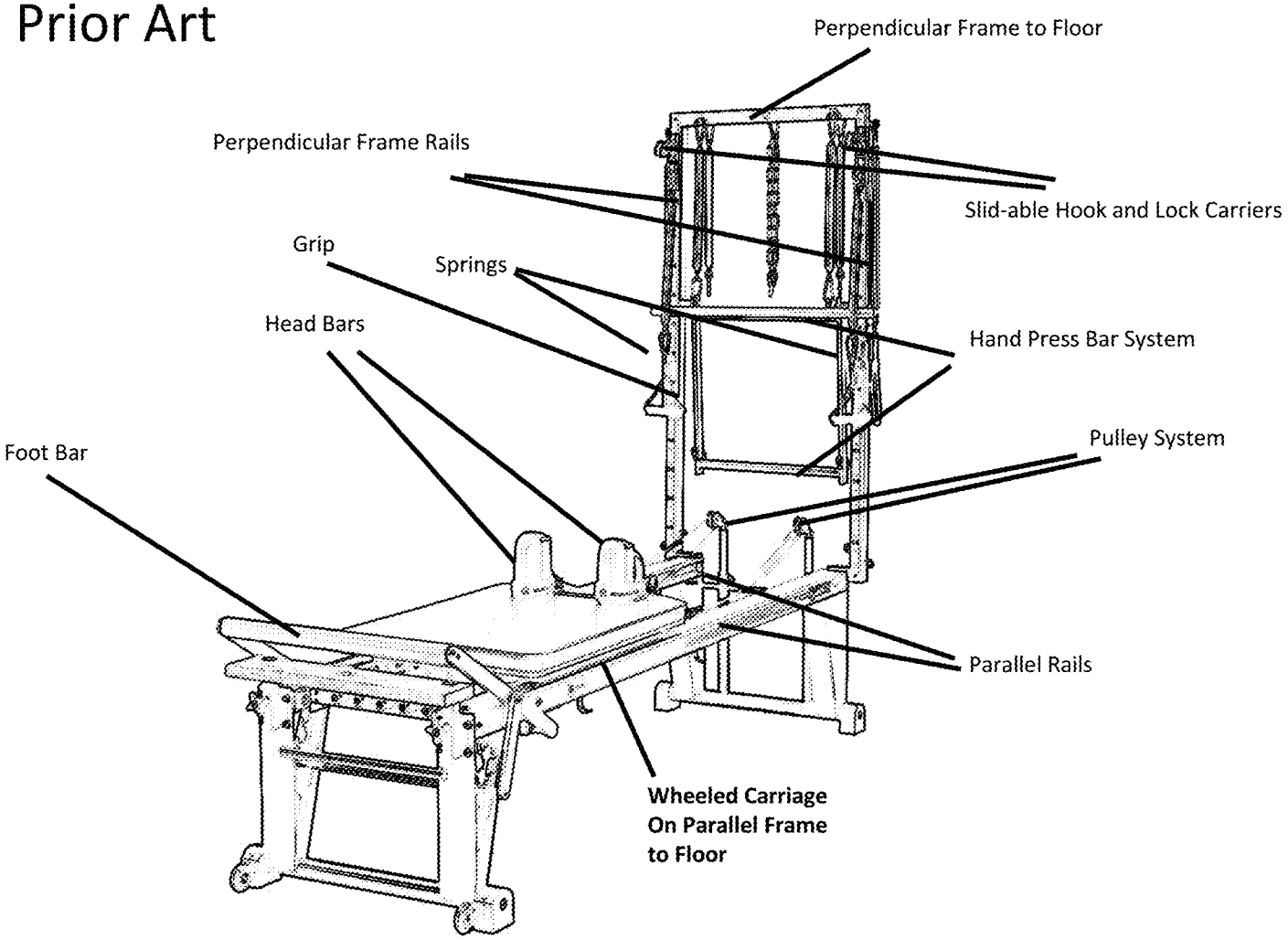
Fig. 1 Prior Art
FIG. 1 shows a known tower reformer that has a wheeled carriage that travels within a limited range along a pair of parallel rails or tracks.
Figure 2:
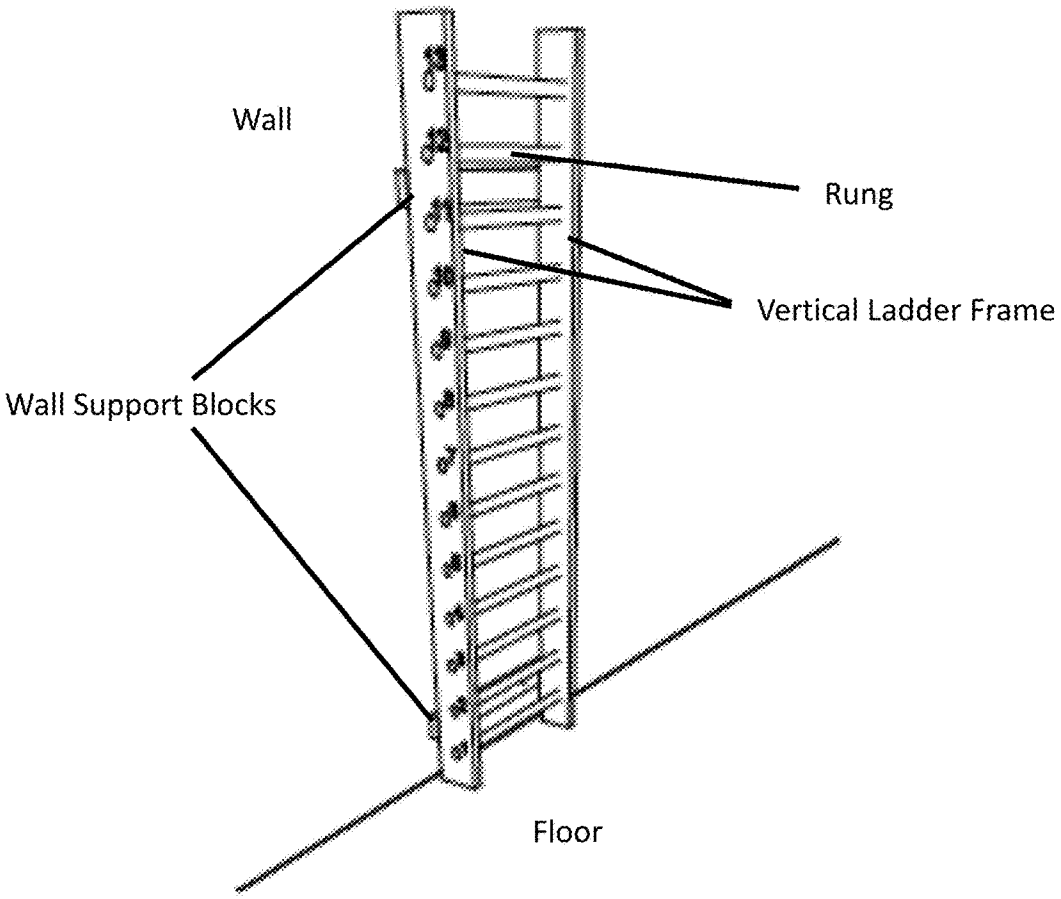
Prior Art Fig. 2
FIG. 2 shows prior art Fuse ladder attached to a wall (or ceiling) that allows the exerciser to perform exercises.
Figure 3:
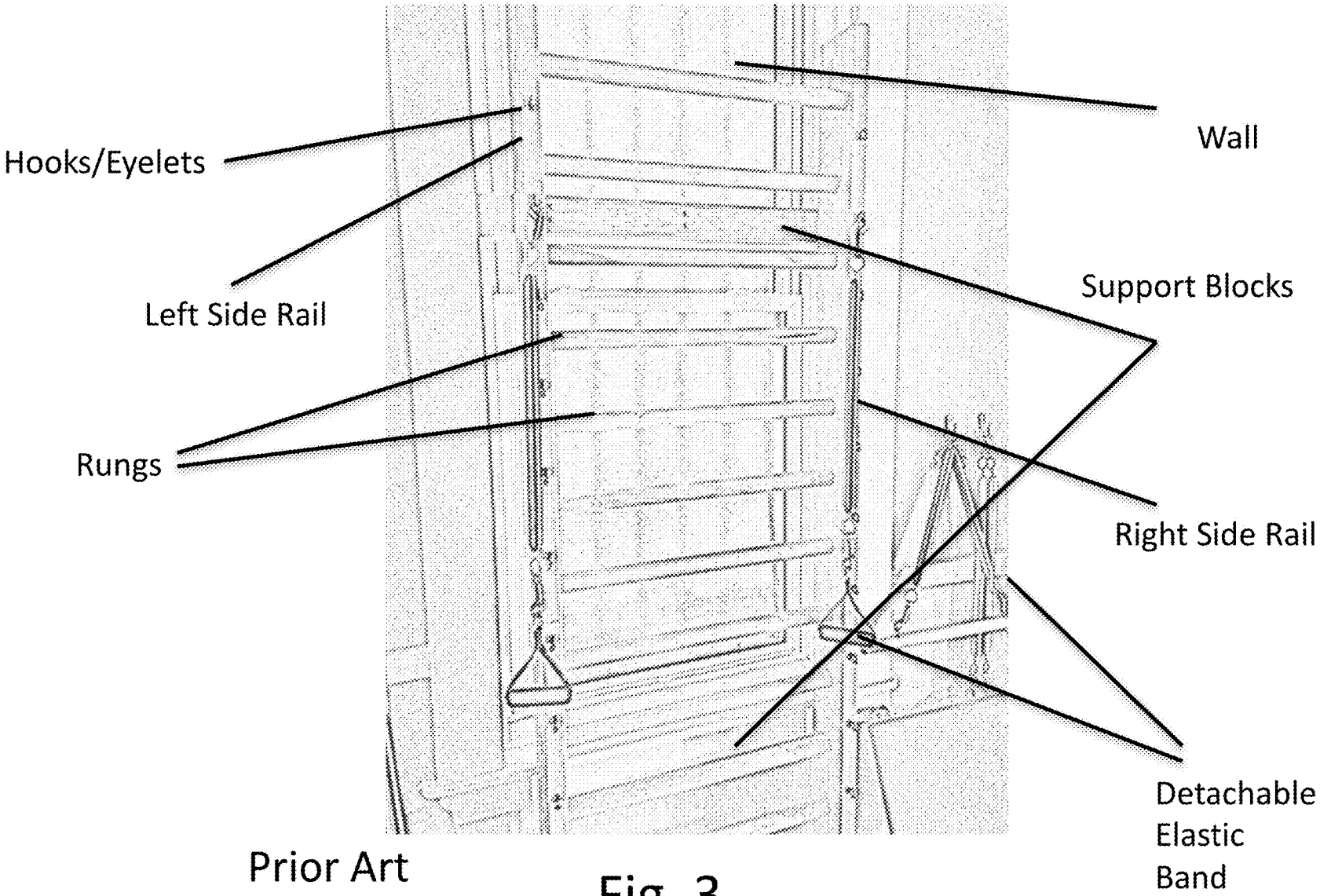
Fig. 3 Prior Art
FIG. 3 shows a partial view of the prior art Fuse ladder of FIG. 2.
Figure 4:
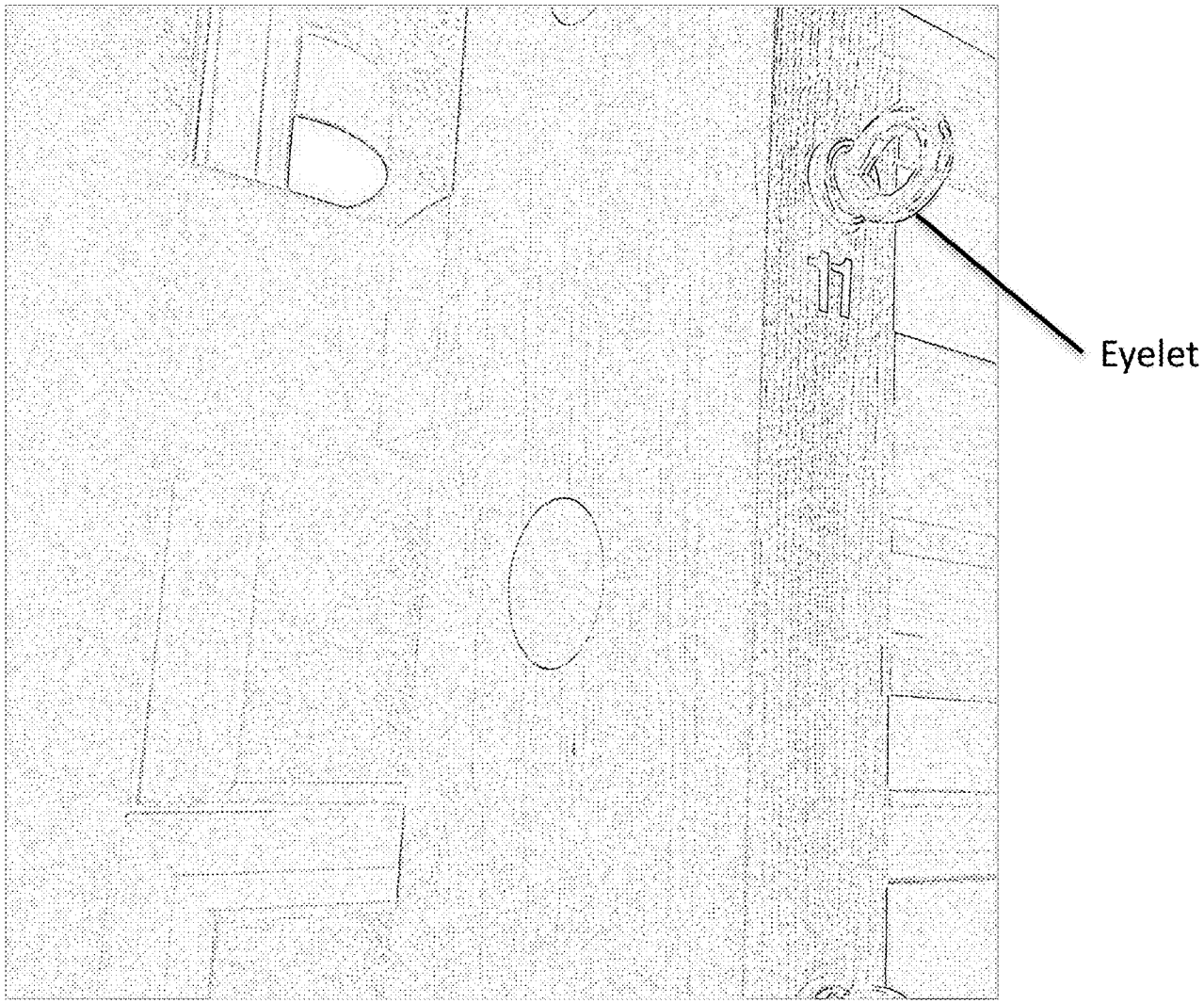
Fig. 4 Prior Art
FIG. 4 shows the eyelets used in the frame ladder of FIG. 3.
Figure 5:
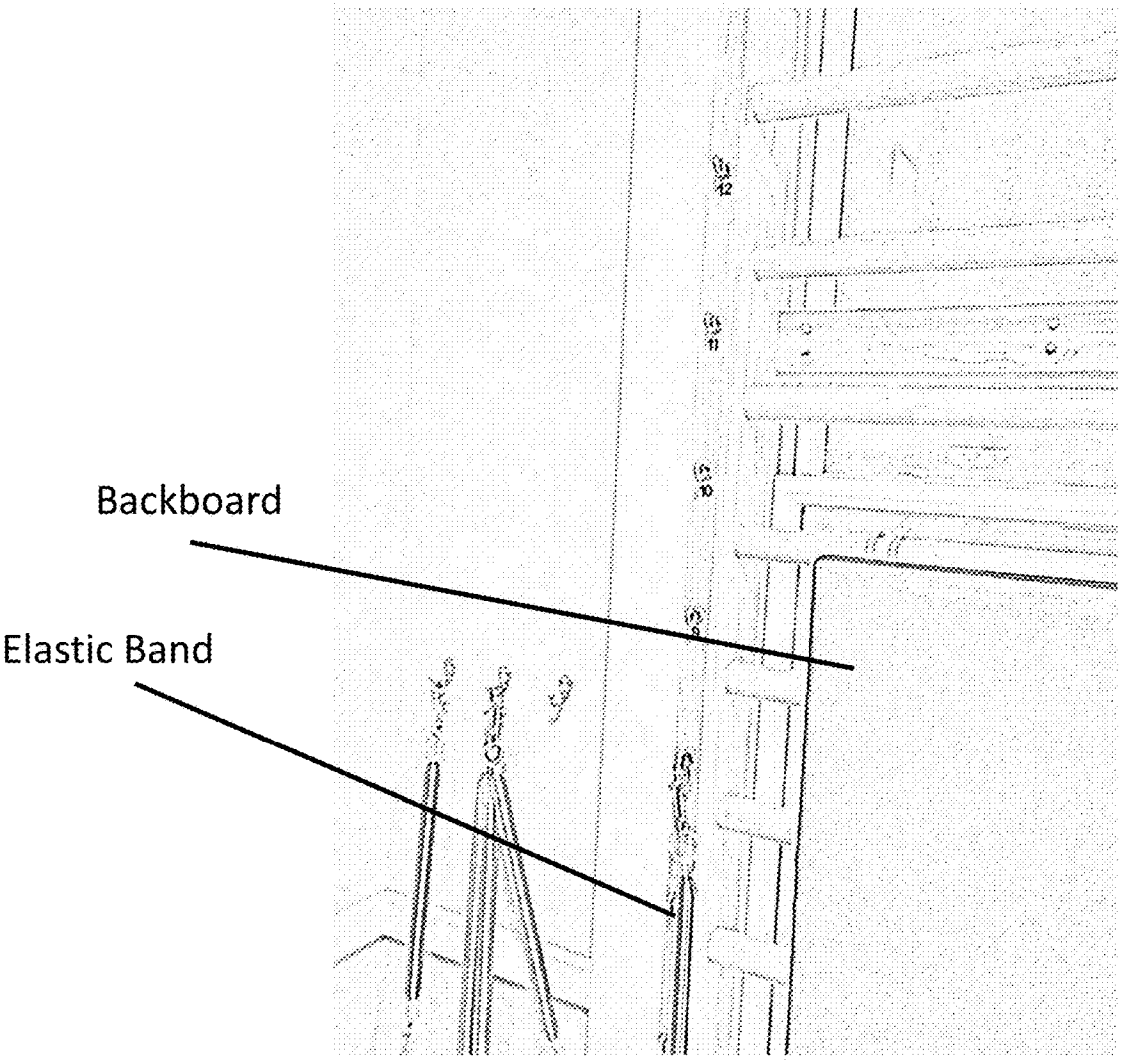
Prior Art Fig. 5
FIG. 5 shows the eyelets of the prior art Fuse ladder of FIG. 2 being used for fixedly attaching elastic bands and a backboard.
Figure 6:
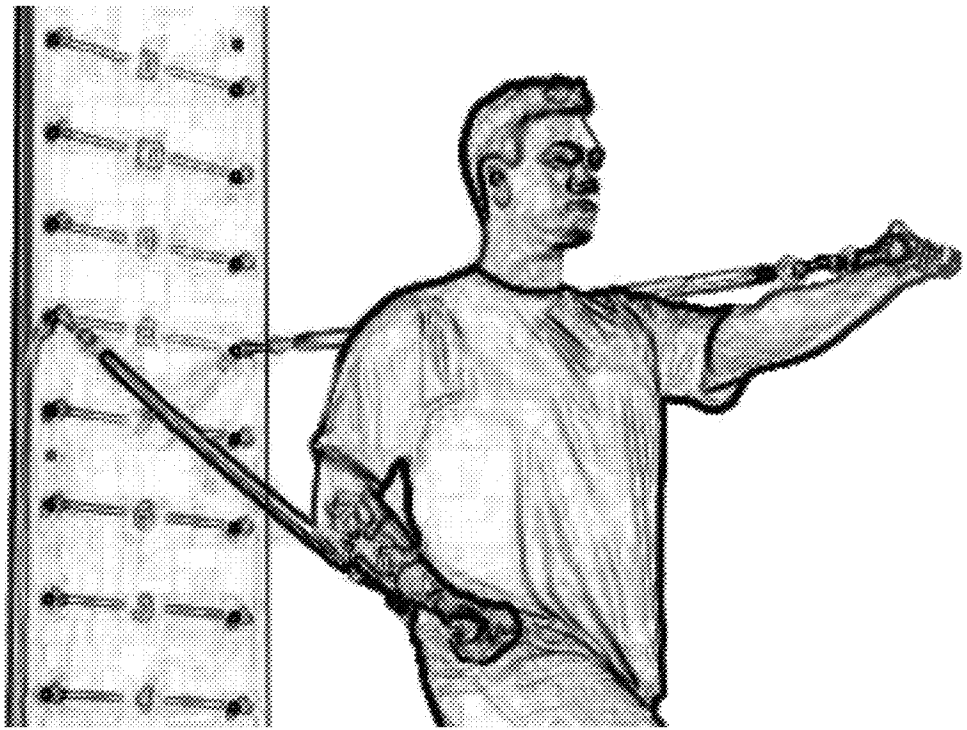
Prior Art Fig. 6
FIG. 6 shows an exerciser using the elastic bands of a prior art springboard in an exercise move.
Figure 7:
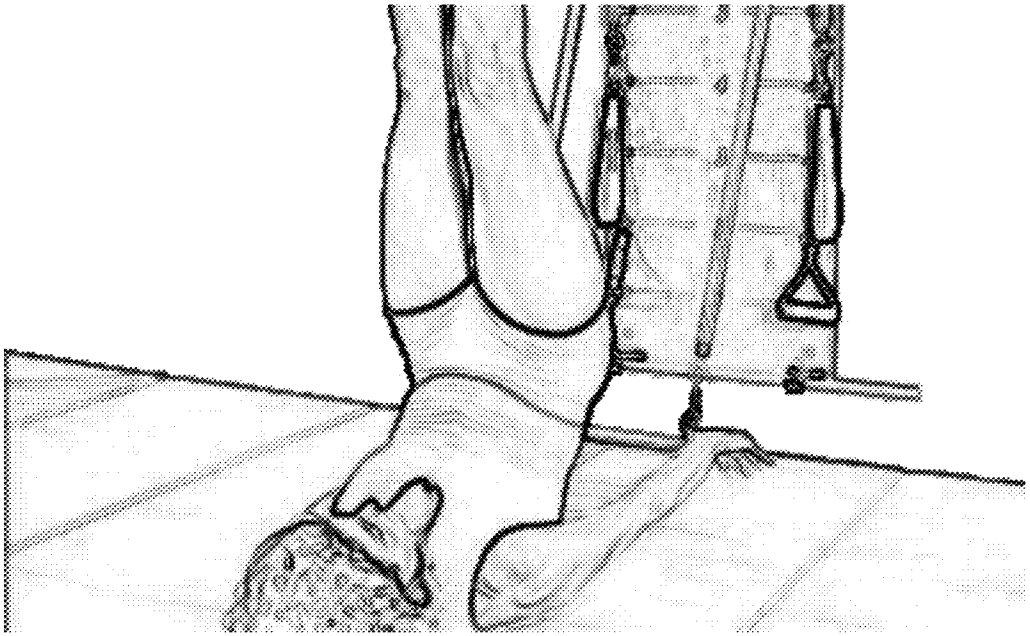
Prior Art Fig. 7
FIG. 7 shows an exerciser using an attachment of a prior art springboard in an exercise move.
Figure 8:
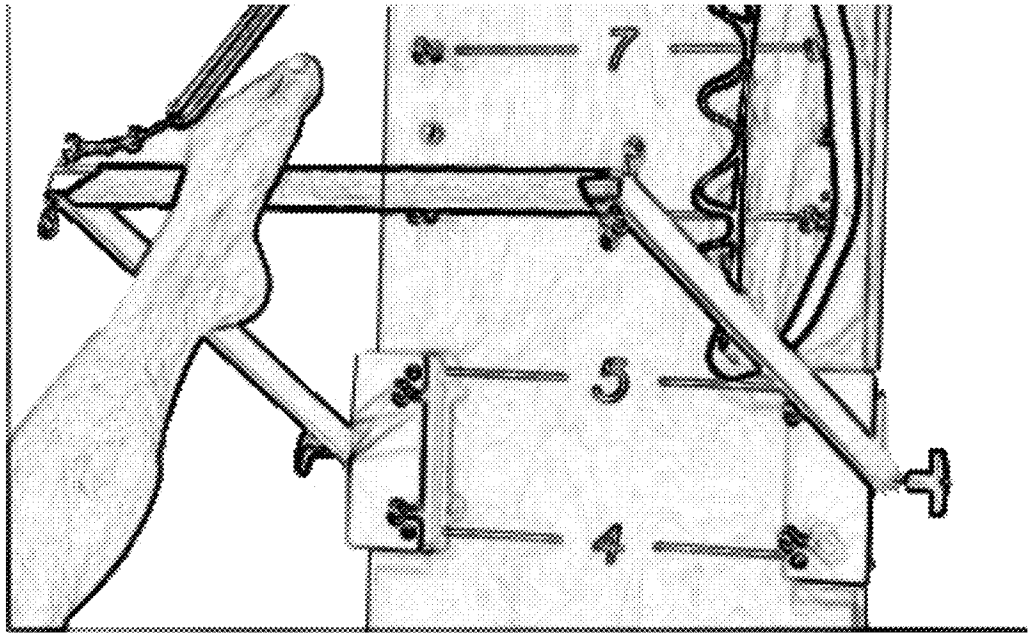
FIG. 8 shows an attachment of the prior art springboard being used in a foot exercise move.

Although many of the classical resistance exercises done with the springs can be executed on Pilates towers as shown in FIGS. 1-5 and springboards as shown in FIGS. 6-8, the ladder of the present invention improves the prior art by enabling a wider range of exercises that involve using rungs and elastic bands for performing elastic resistance exercises. The ladder of the invention offers additional exercises using rungs and elastic bands (e.g., springs) attached to the ladder at adjustable heights set by a lock on a slide-able carrier that carries a hook for attaching an elastic band. The elastic resistance exercises enabled by the present invention allow an exerciser's hand or feet be supported by a fixed rung while the exerciser grips the elastic band (i.e., spring), attached to the hook, which can slide along a track.

Figure 10:
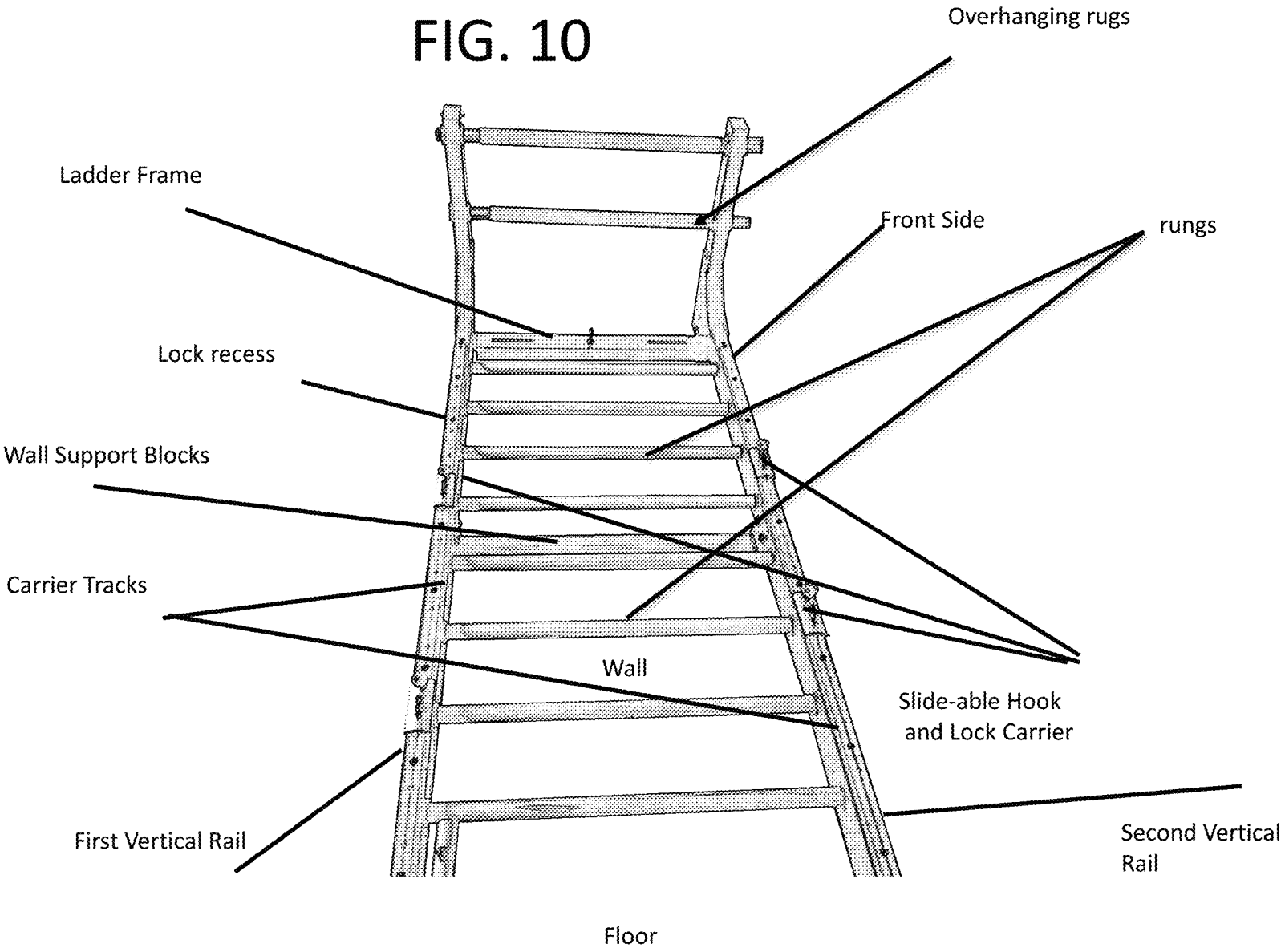
FIG. 10 shows one embodiment of the ladder of the present invention.

FIG. 10 shows one embodiment of the ladder of the present invention comprising a vertical ladder frame that is supported by a wall perpendicular to a floor. The ladder has a ladder frame. The ladder frame includes a first vertical rail and a second vertical rail. Each vertical rail has an upright length, a depth perpendicular to a supporting wall and a width parallel to the wall, which is perpendicular to an exercise floor. The first vertical rail is on the left side of the ladder frame and the second vertical is on the right side of the ladder frame separated from each other to form the width of the frame ladder. The first and second vertical rails extend in parallel along the length of the ladder frame substantially perpendicular to the floor. Each vertical rail has a corresponding longitudinal track formed on its sides. The longitudinal track is used for sliding a carrier of a lock and a hook. A back side of each vertical rail faces the wall and a front side opposite the back side includes a plurality of lock recesses disposed at corresponding heights along the length of the ladder frame.

Figure 9:
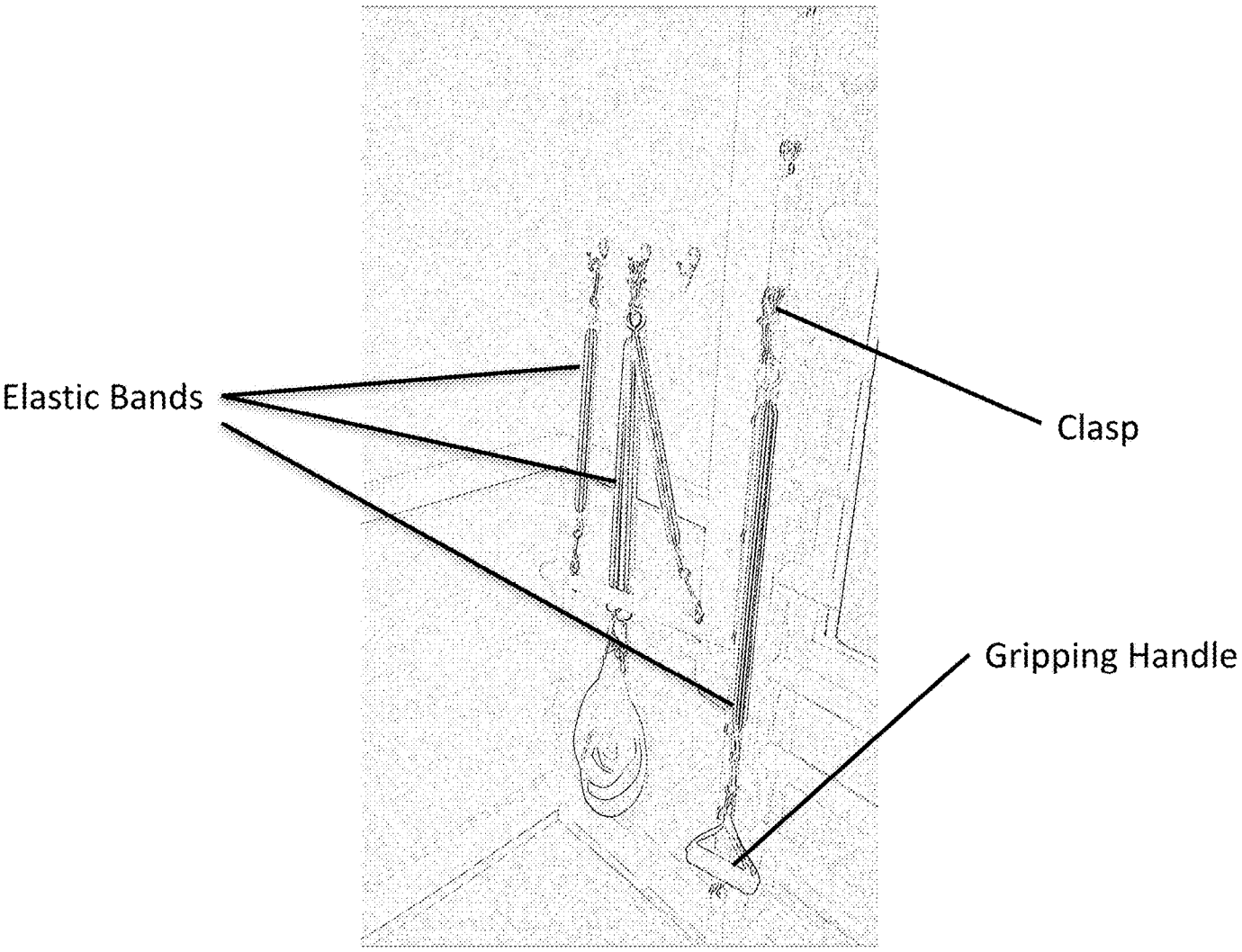
Prior Art Fig. 9
FIG. 9 shows elastic bands in the form of springs or any other type of band with elastic properties.

A detachable elastic band or spring, like the one shown in FIG. 9, can be attached via a hook to a slide-able carrier that slides on the longitudinal track formed on each vertical rail of the ladder frame. A lock disposed on the slide-able carrier locks the position of the hook on the vertical rail at an adjustable height, as shown in FIG. 10. The adjustable height is set by the lock recesses on the front sides of the vertical rails. As such, the detachable elastic band or spring can lock on the vertical rails at various heights of the lock recesses via the lock on the slide-able carrier. The elastic band can be a spring or other type of band with elastic properties with a grip at one end and a hook attachment point, e.g. a clasp, at the other end. The elastic bands can be mounted and dismounted from a hook on the slide-able carrier using the clasp. An exerciser can easily change the height of the hook with a slide action that changes the height of the carrier and a locking action that locks the carrier at an adjustable height. In this way, the present invention allows the exerciser to perform resistance exercises with an elastic band at different heights without having to disengage the elastic band from the hook. The ability to mount the elastic bands to the hook on the slide-able carrier allows for a variety of exercise forms with a resistance provided by the elastic bands.

Figure 11:
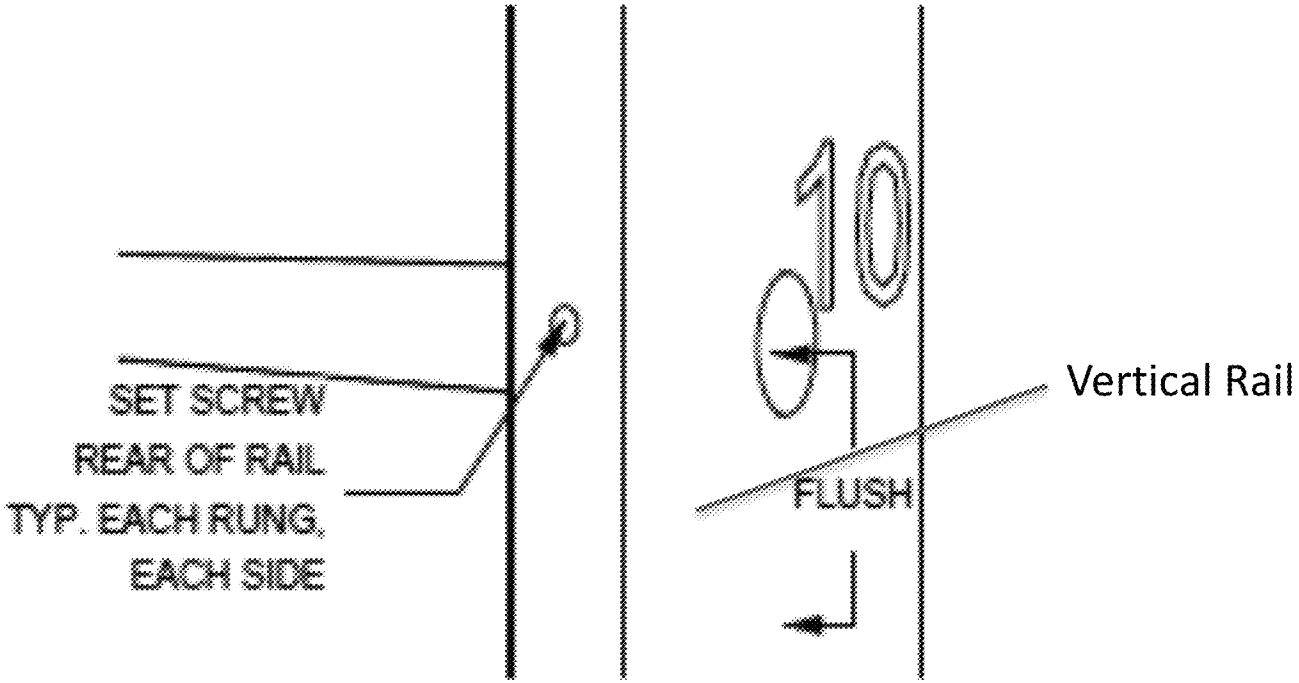
FIG. 11 shows a flushed numbered rung attached to a vertical rail of the ladder of FIG. 10.

The vertical frame ladder has a plurality of numbered rungs attached to a pair of right side and left side vertical rails along their respective vertical lengths. FIG. 11 shows a flushed numbered rung (e.g., rung number 10) attached to a vertical rail. The rungs form ladder steps of the ladder separated from each other by step distances, which may or may not be equal. In one embodiment shown in FIG. 10, the ladder frame has one or more overhanging rungs at the top of the frame along a supporting frame that is perpendicular to the wall.

Figure 12:
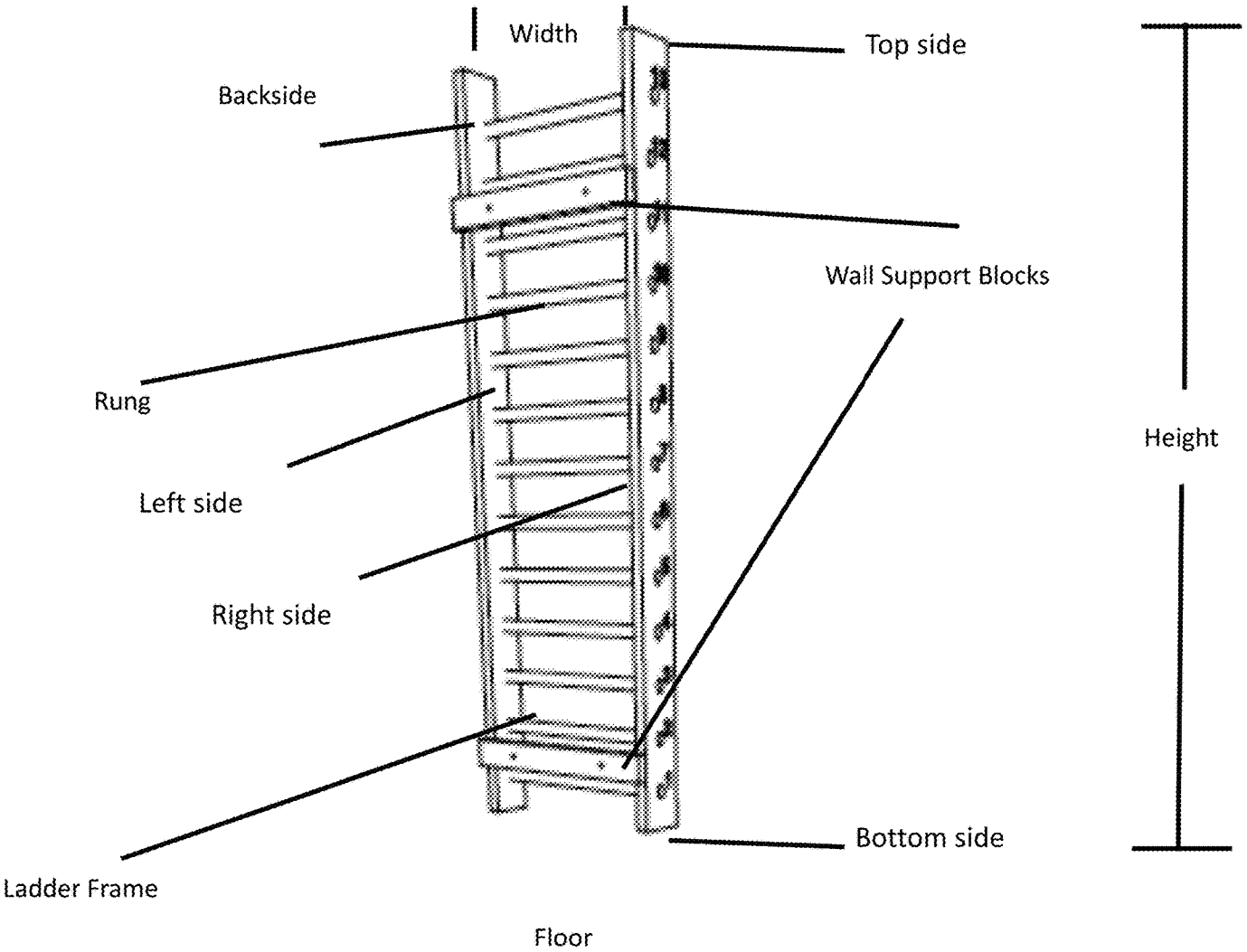
FIG. 12 shows a back view of another embodiment of the ladder with supporting blocks that attach to the wall.

FIG. 12 shows a back view of another embodiment of the ladder frame with supporting blocks that attach to the wall without the overhanging rungs of FIG. 10. As shown in FIG. 12, support blocks secure the ladder frame to a wall that is perpendicular to the exercise floor. Each one of the first and second vertical rails includes a bottom side facing the floor and a top side opposite the bottom side. A plurality of rungs extends along the width of the ladder frame between the right side of the first vertical rail and the left side of the second vertical rail such that each rung is fixed to the first and second of vertical rails at a corresponding rung height along the length of the ladder frame.

Figure 13:
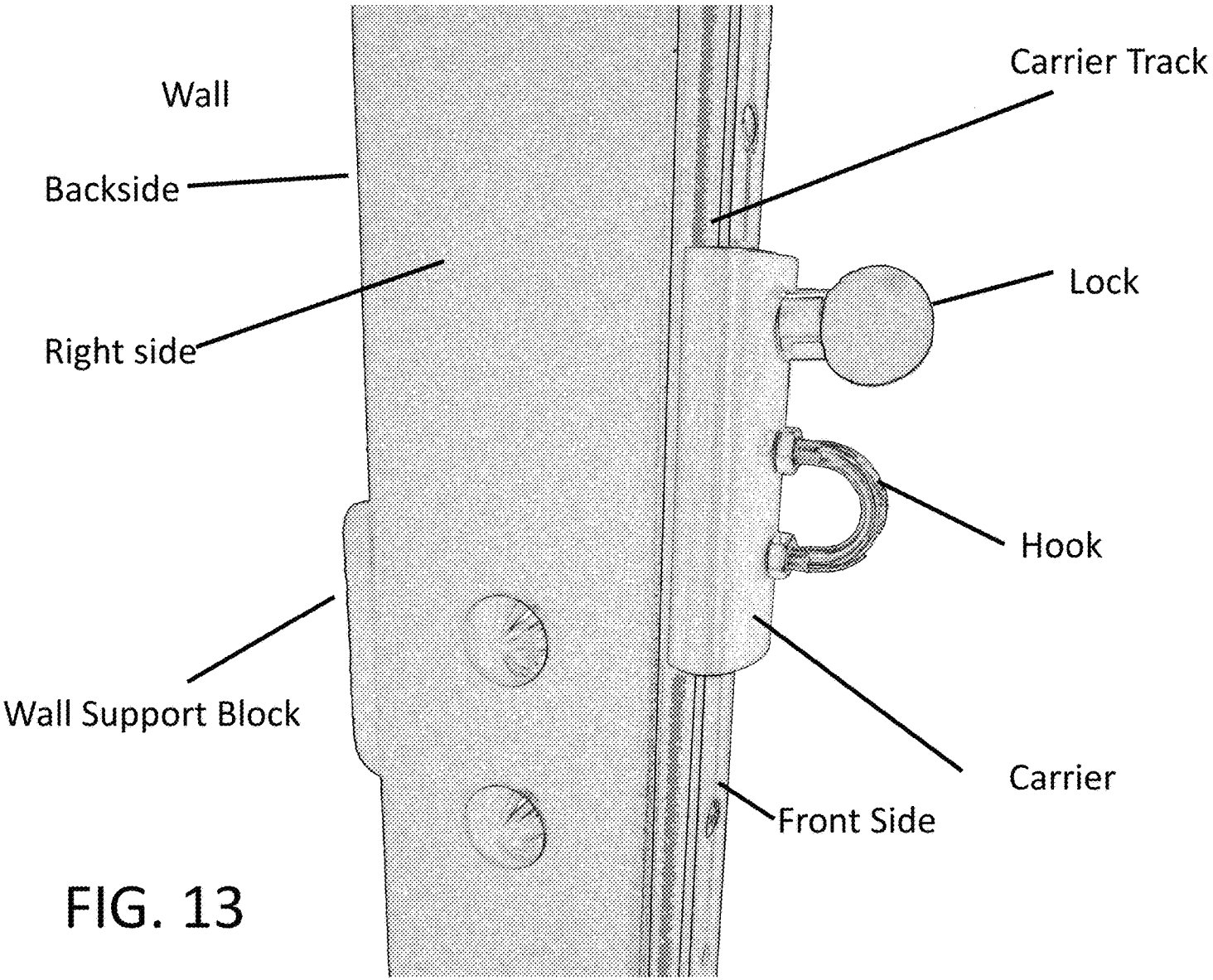
FIG. 13 shows a side view of a vertical rail with a groove that allows the carrier to slide up and down.
Figure 14:
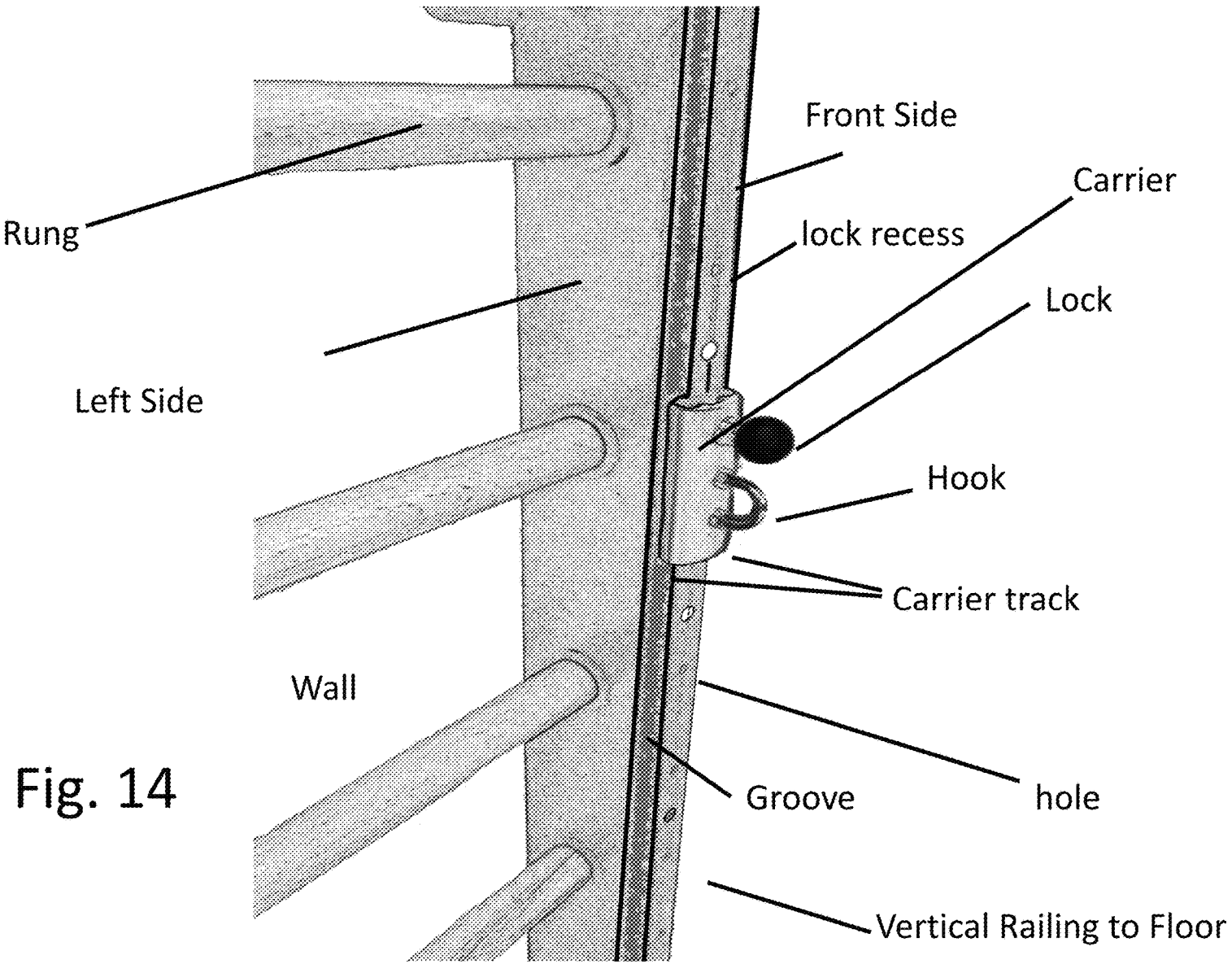
FIG. 14 shows a view of the opposing side of the vertical rail of FIG. 10 with an opposing groove to the one shown in FIG. 13.

FIG. 13 shows an image of one side of a vertical rail with a groove and FIG. 14 shows a view of the opposing side of the vertical rail with another groove. The opposing grooves on the sides of each vertical rail form the longitudinal track for a side-able carrier. The slide-able carrier engages the opposing grooves on each vertical rail allowing the lock and the hook to slide up and down. In this way, the height of the hook can be changed by sliding the carrier. The lock on the slide-able carrier engages the vertical rail and positions the hook at adjustable heights. The vertical rail is equipped with a rail engagement mechanism that engages and disengages the lock on the carrier.

Figure 15:
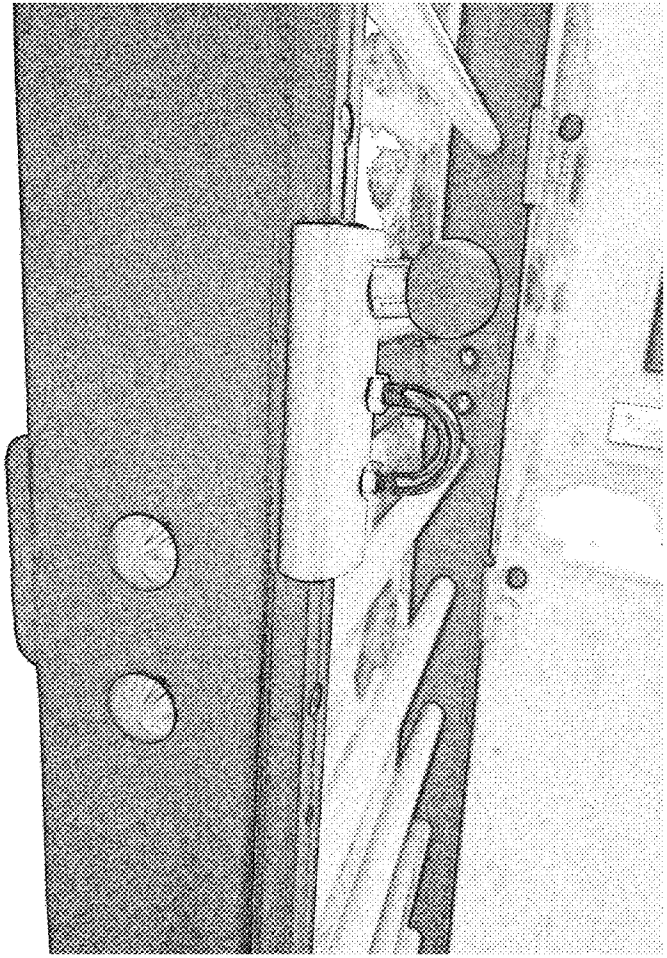
FIG. 15 shows a partial view of the ladder attached to the wall with parallel vertical rails and slide-able carriers attached to each of the vertical rail of FIG. 10.

FIG. 15 shows a partial view of the ladder attached to the wall where a first slide-able carriers is attached to the first vertical rail and a second slide-able carrier is attached to the second vertical rail. Such attachments are facilitated by a rail engagement mechanism, which may be a hole disposed on the front side of each vertical rail. The hole allows a spring-loaded pin on a lock to engage a vertical rail and fix the position of a carrier. The pin can be pulled to disengage the lock from the vertical rail allowing the carrier to slide along the longitudinal track.

As stated above, each one of the first and second slide-able carriers has a corresponding enclosure that carries a hook and a lock. The enclosure engages the longitudinal track at the right and left sides of each vertical rail. The lock carried by the carrier engages and disengages the plurality of lock recesses disposed on the front side of each vertical rail at different lock heights.

Figure 16:
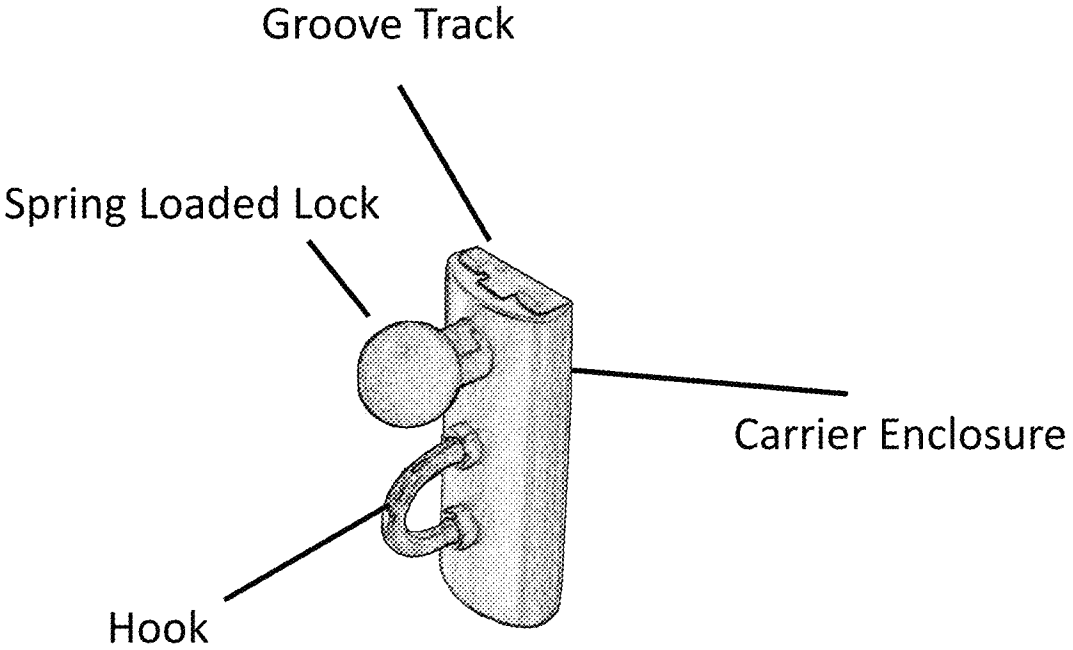
FIG. 16 is a perspective view of the carrier of FIG. 10.
Figure 17:
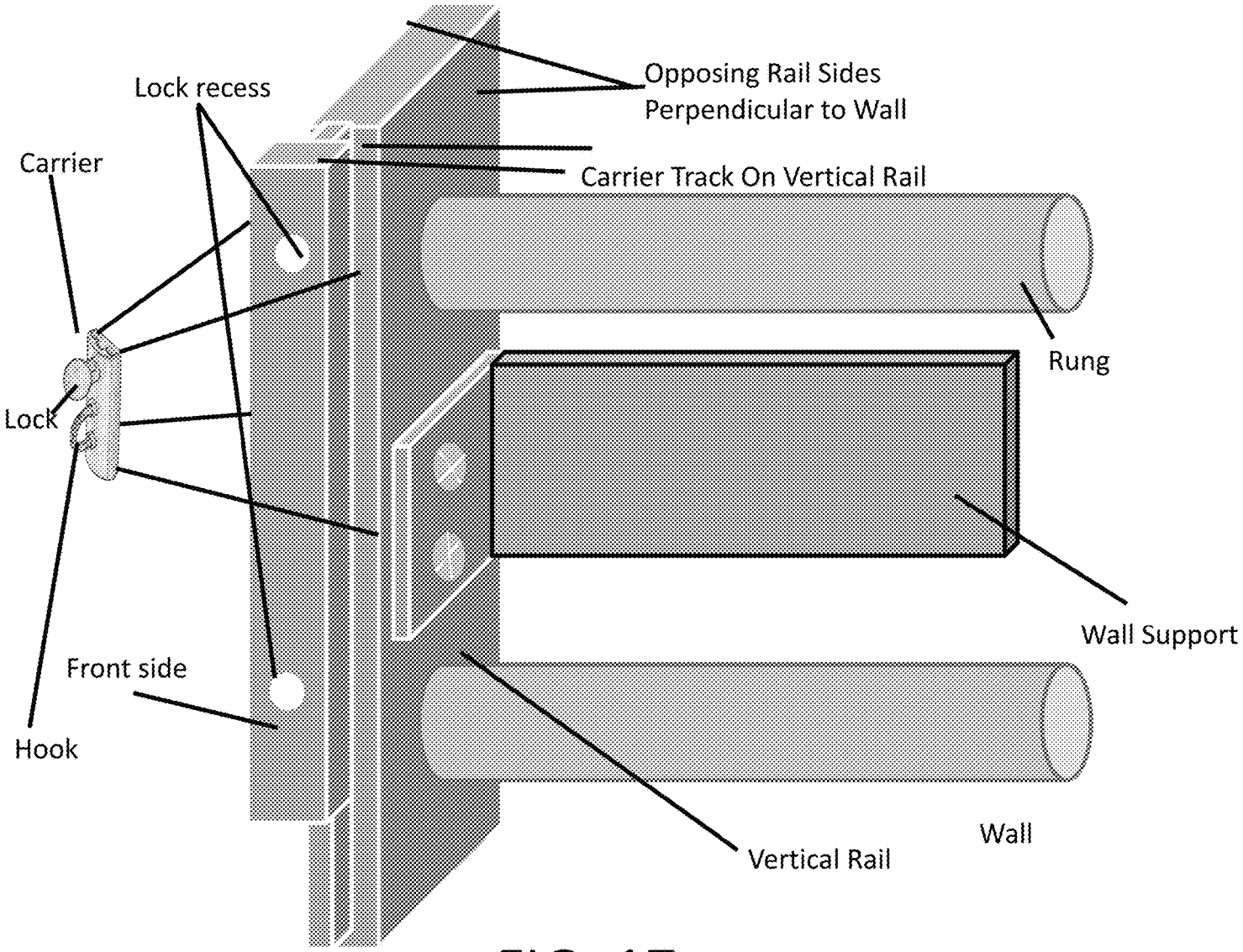
FIG. 17 shows an exploded view of one of the vertical rails with the carrier that carries a hook and a lock of the present invention.

FIG. 16 is a perspective view of a carrier having an enclosure that carries a hook and a lock. In one embodiment, the lock can be a spring-loaded pin that engages a lock recess when released and disengages the lock recess when pulled. The enclosure has a portion that engages the opposing grooves that form the longitudinal track on the vertical railing. The enclosure may be made of any suitable material, metal or plastic, that is rigid enough to allow the carrier to reliably engage with the opposing grooves on the vertical rail and slide up and down. In one embodiment, the carrier is made of aluminum or an alloy thereof. The lock can have a rigid round portion made of plastic for example that allows for pulling the spring-loaded pin to unlock the carrier from the vertical rail FIG. 17 shows an exploded view of one of the vertical rails with the carrier that carries the hook and the lock of the present invention. In one embodiment, the lock is a spring-loaded lock that engages locking holes disposed along the front side of the vertical rail that faces the exerciser. As shown, the front side has a plurality of lock recesses that engage with the lock on the carrier to fix the hook at a position along the length of the vertical rail. An elongated groove running from the top to the bottom of the vertical rail is disposed on each of the two opposing sides. The grooves on each opposing side form the longitudinal track that allows one or more carriers of the hook and the lock to slide up and down along the length of each vertical rail. The hooks on both vertical rails of the ladder allow elastic bands with corresponding grips to be attached and supported by the ladder frame. This arrangement simplifies elastic resistance exercises by the exerciser by obviating the need for the exerciser to connect and disconnect elastic band, e.g., springs, attached to the grips to adjust the height of the gripping handles.

In this way, the exercise apparatus provides a variety of exercises by allowing easy attachment or detachment of removable exercise devices from the main body, which can be affixed to a wall or a ceiling. Numerous exercises can be performed by the ladder of the invention including hanging and climbing (both with hands and with feet) from fixed rungs for elastic resistance exercises at adjustable heights. The ladder rungs can be used as targets to direct a moving arm or leg during an exercise, a place to rest hands or feet during push-up variations, etc. Additionally, the movable backboard can be hung from the ladder's rungs in either a flat or tilted position, depending on the ladder rung, to act as support or to create a challenging angle for additional exercises. The ladder of the present invention has detachable springs (or, alternately, you could use elastic bands) with grips attached to an end that are supported by the upright ladder frame that is perpendicular to the floor. The present invention enables exercises where the exerciser rests a foot on a rung and have their hands gripping a spring. The exerciser can also have a foot in a spring and hands on the rungs of the ladder. Additionally, the exerciser can have both feet in the springs while resting back against the backboard. Other examples would be tilting the backboard out at an angle, resting one's back against it and using the elastic bands or springs to create a counterbalance to lift the weight of the legs against. The exerciser can also hang the backboard higher and use it to support the back while doing hanging exercises. The exerciser could put her or his feet in springs set at a high setting to assist with pull ups or facing away from the tower, to help with hanging leg lifts. The ladder can also be used by having the exerciser rest an arm or hand on the ladder, lean away with both feet on the floor, and bring the top hand into a spring to do arm exercises while holding a challenging side plank. Another exercise would involve resting the feet on a ladder rung, grabbing a spring with one hand while bringing the other hand to the floor for a plank or pushup variation. The exerciser can hold a spring in both hands overhead and press into the ladder with the inside foot to do weighted side bends.

The foregoing examples and limitations related therewith are intended to be illustrative and not exclusive. Other limitations of the invention will become apparent to those of skill in the art upon a reading of the specification and a study of the drawings.

The invention claimed is:

1. A ladder comprising:

a vertical ladder frame including:

one or more wall support blocks configured to fix the vertical ladder frame against a wall that is perpendicular to a floor;

a first vertical rail and a second vertical that are separated from each other to form a width of the vertical ladder frame, the first and second vertical rails extending in parallel along a length of the vertical ladder frame perpendicular to the floor, wherein each one of the first and second vertical rails includes:

a bottom side facing the floor, a top side forming opposing the bottom side, a back side facing the wall, and a front side opposite the back side, wherein the front side of the vertical rail includes a plurality of lock recesses disposed at corresponding lock heights along the length of the ladder frame;

each of the first and second vertical rails furthering including:

a right side and a left side disposed between the front side and the back side, wherein the right side opposes the left side to form a corresponding longitudinal track on each one of the first and second vertical rails, and a plurality of rungs that extend along the width of vertical ladder frame between the first vertical rail and the second vertical rail, wherein each of the plurality of rungs is fixedly attached to the first and second of vertical rails at a respective fixed rung height, at least one first slide-able carrier attached to the first vertical rail and at least one second slide-able carrier attached to the second vertical rail, each one of the at least one first and the at least one second slide-able carriers having a corresponding enclosure that carries a hook and a lock, the corresponding enclosure engaging the longitudinal track at the right and left sides of each of the first and second vertical rails, wherein in the locks carried by the at least one first slide-able carrier and the at least one second slide-able carrier engages and disengages the plurality of lock recesses disposed on the front side of each of the first and second vertical rails at different lock heights, and at least one elastic band having a grip that is detachably connected to the hook carried by at least one of the at least one first slide-able carrier or the at least one second slide-able carrier.

2. The ladder of claim 1, wherein the plurality of lock recesses comprise holes or indentations disposed on the front side of each of the first and second vertical rails.

3. The ladder of claim 2, wherein the lock comprises a spring-loaded pin that engages the holes or indentations.

4. The ladder of claim 1 further including a backboard attached to a rung of the plurality of rungs at a corresponding rung height.

5. The ladder of claim 1, wherein each of the tracks are formed by opposing longitudinal grooves on the right and left sides of each of the first and second vertical rails.

6. The ladder of claim 1 further comprising overhang rungs extending from the top sides of the first and second vertical rails.

* * * * *